US006168708B1

(12) United States Patent
Burbridge et al.

(10) Patent No.: US 6,168,708 B1
(45) Date of Patent: Jan. 2, 2001

(54) METHOD FOR RECOVERY AND RECYCLING OF HYDROCARBON RESIDUE

(75) Inventors: Carol S. Burbridge, Anaheim; George W. Johnson, Palos Verdes Estates; John P. Nakamura, Long Beach; Gary Tietavainen, Los Alamitos, all of CA (US)

(73) Assignee: Atlantic Richfield Company, Chicago, IL (US)

( * ) Notice: Under 35 U.S.C. 154(b), the term of this patent shall be extended for 0 days.

(21) Appl. No.: 09/296,476

(22) Filed: Apr. 22, 1999

(51) Int. Cl.[7] ..... C10G 73/42; C10C 1/20
(52) U.S. Cl. ..... 208/27; 208/13; 208/428
(58) Field of Search ..... 208/13, 27, 31, 208/33, 36, 44, 45, 311, 312, 320, 322, 390, 428, 431

(56) References Cited

U.S. PATENT DOCUMENTS 4,211,633 * 7/1980 Gleim ..... 208/45
5,843,301 * 12/1998 Esztergar et al. ..... 208/309

OTHER PUBLICATIONS

Petroleum Refinery Engineering, Chemical Engineering Series, Chapter XXVII "Solvent Treating of Extraction Processes," pp. 616–646, McGraw–Hill Book Co., 1941.

* cited by examiner

*Primary Examiner*—Bekir L. Yildirim
(74) *Attorney, Agent, or Firm*—Robert A. Yesukevich

(57) ABSTRACT

The present invention provides for a method for recovering and recycling a hydrocarbon residue from a petroleum material such as crude oil, where the hydrocarbon residue is a waxy solid material. The method comprises providing the hydrocarbon residue in a first vessel; heating a sufficient amount of an organic solvent in a second vessel at an effective temperature for an effective period of time; removing the hydrocarbon residue from the first vessel and adding the hydrocarbon residue to the heated solvent in the second vessel; simultaneously mixing and heating the hydrocarbon residue and the solvent in the second vessel at an effective temperature for an effective period of time to cause a reaction between the hydrocarbon residue and the solvent to produce a liquefied hydrocarbon residue product; pumping the liquefied hydrocarbon residue product out of the second vessel and into a third vessel; and, recycling the liquefied hydrocarbon residue into a usable oil refinery product.

18 Claims, No Drawings

METHOD FOR RECOVERY AND RECYCLING OF HYDROCARBON RESIDUE

BACKGROUND

The present invention relates to a method for recovery of hydrocarbon residue, such as crude oil residue or petroleum based residue that accumulates in vessels, such as ships for transporting crude oil, storage tanks for housing crude oil, crude oil pipelines, and other types of storage or transport vessels for petroleum or crude oil that are used in the petroleum industry. In addition, the present invention relates to a method for recycling the hydrocarbon residue once it is recovered.

Certain types of crude oil, such as Alaskan North Slope crude oil, and certain types of petroleum based products contain a hydrocarbon component that over time settles out onto the interior portions of storage tanks and vessels. This hydrocarbon component is typically in the form of a waxy or wax-like solid material. Once this hydrocarbon component settles out from the crude oil or petroleum material and accumulates in a storage tank, it is very difficult to remove or recover. Such storage tanks or vessels that contain the crude oil or petroleum product are commonly found on ships, at terminals, and at refineries.

It is often necessary that the ships used to carry petroleum or crude oil, as well as the petroleum or crude oil storage tanks, undergo a complete and thorough cleaning. Such complete and thorough cleaning, which includes the removal or recovery of hydrocarbon residues from the ships and storage tanks, often occurs prior to a Critical Area Inspection Program (CAIP), prior to unplanned or necessary tank repairs, prior to sale or storage of a ship or tank, prior to a product change in a ship or tank, or prior to the docking or storing of a ship at a shipyard. Currently, the expense and time involved in the recovery and disposal of hydrocarbon residues from all of these various cleaning operations is very high. In addition, the ships must be cleaned, and in particular, prior to docking or storing at the shipyard, because often there is much welding and repair taking place at the shipyard and the potential for electrical fires or explosions is high. When the ships or storage tanks are cleaned, it is desirable that substantially all of the hydrocarbon residue be removed from the ships or storage tanks in order to eliminate the potential risk of fires or explosions.

Known methods for removing hydrocarbon residue or petroleum based residue from petroleum tanks exist. For example, crude oil washing machines are typically used to clean storage tanks to remove or recover hydrocarbon residue. However, a difficulty with known crude oil washing machines is that they do not recover 100% of the hydrocarbon residue. In many ship designs, crude oil washing machines typically only remove or recover up to 85% of the hydrocarbon residue. Due to the internal structure of the storage tanks, numerous "shadow areas" exist in the tanks, i.e., in corners and areas where the crude oil washing machines cannot reach. Thus, the hydrocarbon residue accumulated in these "shadow areas" is not removed or recovered, leaving the potential risk of fire or explosion.

In addition, known methods for removing and disposing of hydrocarbon residue are costly and time consuming. Removing the hydrocarbon residue from a single crude oil storage tank, which may typically hold up to 500,000 barrels of oil, sludge, gasoline, water, hydrocarbons, or other types of materials, may take several days to remove and can be extremely costly. The typical amount of time it takes to remove the hydrocarbon residue from the ship and tanks may take up to a month. In addition, the expense involved in removing the hydrocarbon residue from the tank may easily cost several hundred thousand dollars per ship or refinery. Moreover, once the hydrocarbon residue has been removed from the tank, there are additional costs and time involved in handling and transporting the hydrocarbon residue to another location at a distant site, and in particular, if the hydrocarbon residue is treated as a waste stream product. There are also additional costs involved in disposing of the hydrocarbon residue, such as costs for waste incineration at a federally approved treatment facility and transportation costs. Moreover, there are issues of potential liability for disposal of waste stream products at federally approved treatment facilities.

In addition, known methods for removing hydrocarbon residue from storage tanks often involve disposing of the hydrocarbon residue into a waste stream rather than converting or recycling the hydrocarbon residue into a usable refinery product. Such disposal of hydrocarbon residues or other petroleum residues into a waste stream has the potential for contaminating land or water environments, and in turn, has the potential for creating liability problems for the entity disposing of the hydrocarbon residue as waste.

Accordingly, there is a need for a method for recovering and recycling hydrocarbon residue or petroleum based residue from crude oil, where the hydrocarbon residue is typically in the form of a waxy solid material. In addition, there is a need for a method for recovering all or substantially all of the hydrocarbon residue remaining in a ship or storage vessel after it has been initially cleaned with known washing methods and machines, such that the method of recovery decreases or eliminates the potential risk of fire or explosion. In addition, there is a need for a method for recovering and recycling hydrocarbon residue from crude oil that decreases the overall costs of removal and disposal of the hydrocarbon residue from storage tanks or vessels; that decreases the overall time for removal and disposal of the hydrocarbon residue from storage tanks or vessels; that decreases or eliminates the handling, transport, and disposal of the hydrocarbon residue to another location once it is removed from the storage tank or vessel, and thus decreases the associated time and expense involved; that allows for conversion or recycling of the hydrocarbon residue from a waste stream product to a usable refinery product; and, that eliminates potential liability for environmental contamination due to the disposal of the waste stream product, and in particular, the potential liability involved with disposal at federally approved treatment facilities.

The present invention satisfies these needs and provides all of these advantages over known methods for removal and recycling of hydrocarbon residue from crude oil.

SUMMARY

The present invention is directed to a method for the recovery and recycling of hydrocarbon residue from a petroleum material such as crude oil. Such hydrocarbon residue is typically in the form of a solid waxy material that accumulates in storage tanks or vessels used in the petroleum, or oil industry. The present invention has numerous advantages over known methods. The present invention increases the total recovery of the hydrocarbon residue from the storage tank or vessel so that all or substantially all of the hydrocarbon residue is recovered, and the potential risk of fire or explosion in the tank is decreased or eliminated. The present invention decreases the overall cost and time involved for recovery and disposal of the hydrocarbon residue from the storage tanks or vessels, and decreases or eliminates the handling, transport, and disposal of the hydrocarbon residue to another location once it is removed from the storage tank or vessel, which also decreases the associated time and expense involved. The present invention allows for the recycling of the hydrocarbon residue from a waste stream product to a usable refinery product, and in turn, eliminates any potential liability for environmental contamination due to the disposal of the waste stream product.

The present invention provides for a method for recovering and recycling a hydrocarbon residue from a petroleum product such as crude oil. The method comprises providing a hydrocarbon residue in a first vessel, such as a cardboard box lined with a polypropylene lining, wherein the hydrocarbon residue is in the form of a solid waxy material; heating a sufficient amount of an organic solvent in a second vessel, such as a sealed steel mixing tank, at a temperature in the range of from about 130 degrees F. to about 200 degrees F. for an effective period of time; removing the hydrocarbon residue from the first vessel and adding the hydrocarbon residue to the heated solvent in the second vessel; simultaneously mixing and heating the hydrocarbon residue and the solvent in the second vessel at a temperature in the range of from about 130 degrees F. to about 200 degrees F. for an effective period of time to cause a reaction between the hydrocarbon residue and the solvent to produce a liquefied hydrocarbon residue product; pumping the liquefied hydrocarbon residue product out of the second vessel and into a third vessel; and, recycling the liquefied hydrocarbon residue into a usable oil refinery product. Preferably, the organic solvent is selected from the group consisting of gas oil, diesel oil, stove oil (jet fuel), toluene, cyclohexane, naphtha, and xylenes.

These and other features, aspects, and advantages of the present invention will become better understood with reference to the following description, appended claims, and accompanying drawings.

DESCRIPTION

The present invention relates to a method for recovery of hydrocarbon residue, such as crude oil residue or petroleum based residue that accumulates in vessels, such as ships for transporting crude oil, storage tanks for housing crude oil, crude oil pipelines, and other types of storage or transport vessels for crude oil that are used in the petroleum industry. In addition, the present invention relates to a method for recycling the hydrocarbon residue once it is recovered.

The hydrocarbon residue collected in the present invention is typically a solid heavy waxy material that settles out from various types of crude oil, such as Alaskan North Slope Crude Oil, which is collected, transported and stored on oil tanker ships. Various samples of hydrocarbon residue were collected from oil tanker ships containing Alaskan North Slope Crude Oil and were analyzed to determine their contents. The hydrocarbon residue may be collected in various ways, such as from clean-up operations of oil tankers, barges and petroleum storage vessels, from oil pipelines, and from other clean-up operations at refineries. The typical composition of the hydrocarbon residue used in the present invention comprises the following (all of the components are weight percents of the total composition): 0% to 25% (by weight of the total composition) water; 70% to 100% (by weight of the total composition) hydrocarbons; and 0% to 5% (by weight of the total composition) inorganic solids. As set forth in Example I, the typical composition comprises 16% by weight water, 81% by weight hydrocarbons, and 3% by weight inorganic solids. Typical hydrocarbons found in the composition include pentane insolubles, saturates, aromatics, and polars. Typical inorganic solids found in the composition include aluminosilicates, dirts, clays, and scale.

Typically, the oil tanks or vessels are initially cleaned with known crude oil washing machines which clean and dispose of up to about 85% of the hydrocarbon residue. Crude oil washing machines are typically part of a ship's equipment, and cleaning is usually performed during cargo discharge of the ship. A typical crude oil washing machine used is one obtained from Victor Pyrate Inc. of Houston, Tex. However, due to the internal structure of the tanks, numerous "shadow areas" exist where the crude oil washing machines cannot reach and the hydrocarbon residue is not removed. For purposes of this invention, the remaining hydrocarbon residue accumulated in these "shadow areas" of the tank or vessel is recovered, collected, and provided for use in the method of the present invention. In order to remove and collect the hydrocarbon residue that is not removed with conventional crude oil washing machines, the hydrocarbon residue is typically collected by using a scraping device such as a knife, shovel, pole, or other suitable device, to manually scrape the remaining hydrocarbon residue off the sides, bottoms, and other interior portions of a standard oil tank or vessel where the hydrocarbon residue has accumulated.

Once the hydrocarbon residue is collected, it is stored in a first vessel. The first vessel may comprise a cardboard box completely lined with a weatherproof polypropylene lining, a steel cylindrical drum container, a steel bin with rollers which is commonly referred to in the industry as a roll-off bin, canvas bags, or another suitable storage vessel. Preferably, the first vessel is a corrugated cardboard box having a weatherproof, waterproof, polypropylene material lined over the entire box, having a closure device for sealing the box, having a capacity of 220 gallons, and having a thickness of ¼ inch, such box being obtained from Southcoast Filtration of Fountain Valley, Calif. If a steel cylindrical drum container is used, typically it has a lid that can be sealed, it has a capacity of 55 gallons, and it has a thickness of about ⅛ inch to about ¼ inch. In a typical clean-up operation of an oil tanker ship that is used to transport and store crude oil, numerous drums of hydrocarbon residue, typically in the amount of 200 or more 55 gallon steel drums, may be generated. Once the hydrocarbon residue is collected and recovered in the first vessels, it may be stored in the first vessels for a time period of from several days to several weeks.

The first vessels containing the hydrocarbon residue are removed from the ship or area where they are being stored, and are transported via truck or train to a refinery, a terminal, or another desired location for processing. Preferably, the first vessels are transported to a refinery for processing. At the refinery, the first vessels are transported or moved to a second vessel for processing. The first vessels may be transported to the second vessel via a forklift or another suitable transport and handling device. The second vessel may comprise a sealable tank containing a heater component and a mixing component, such as the type of tank known in the industry as a Baker tank; a large portable sealable tank; a permanent sealable tank fixed to the ground; or some other suitable containment vessel. Preferably, the second vessel is a portable tank comprised of steel. More preferably, the second vessel is a portable Baker tank made of steel, such as one obtained from Baker Tank of Southgate, Calif. The Baker tank preferably has a capacity of from about 50 barrels (2100 gallons) to about 500 barrels (21,000 gallons), with the more preferred capacity being 500 gallons (21,000 barrels). The Baker tank is typically rectangular in shape, has closed sides, and has a removable top cover with one or more hatch openings in the top cover being of such a size that enables entry by a worker into the interior of the tank. The Baker tank is preferably sealed during processing of the hydrocarbon residue. The Baker tank may have a thickness of from about ¼ inch to about ⅜ inch. The Baker tank may be powered with an electrical power source having power of about 440 volts. The second vessel may be powered with an electric motor, an air driven motor, or another suitable power source.

Preferably, the second vessel or Baker tank includes a heating element that is coupled to an interior portion of the tank. The heating element may comprise steel tubing with steam coils inside the tubing so that steam that is generated flows through the coils, and in turn, heats the tank. The heating element may also comprise an electrical heating element. The second vessel or Baker tank has the capability of mixing or circulating the contents of the tank. In one version, the tank may have at least one mixing element, and preferably has 3 mixing elements. The mixing element or elements may comprise motorized mixing blades coupled to the interior of the tank, that in operation, rotate inside the tank to stir or mix the contents of the tank. The mixing elements may be controlled with control buttons on the outside of the tank. In another version, the contents of the tank may be mixed or circulated with a pump device that circulates the contents of the tank by pumping the contents of the tank out of the tank through a first end of a rubber tubing element connected to one side of the tank and back into the tank through a second opposite end of the rubber tubing element connected to a second side of the tank. The pump and circulation device may be controlled with one or more stop valves connected to the rubber tubing element. The second vessel or Baker tank further includes at least one connecting element for connecting the second vessel to a third vessel, which is further described below. Preferably, the connecting element is in the form of a rubber hose or steel tubing having a diameter of about 4 inches to about 6 inches, and having a length of between about 4 feet to about 50 feet. The connecting element has a first open end coupled to the side of the second vessel and a second open end coupled to the third vessel. The flow of the contents through the connecting element may be controlled by stop valves coupled to the connecting element. The purpose of the connecting element is to transport the processed hydrocarbon residue out of the second vessel and into the third vessel where it is stored for recycling. The second vessel or Baker tank further comprises a pump element for pumping the processed hydrocarbon residue out of the second vessel, through the connecting element, and into the third vessel. The pump element may comprise a portable diesel driven pump such as one obtained from Godwin Pump of America of Bridgeport, N.J. Preferably, the pump is located on an exterior side of the second vessel and is controlled manually from the outside of the tank. The second vessel or Baker tank may further comprise a carbon cannister for vapor control and control of atmospheric pressure. The second vessel or Baker tank may further comprise a temperature gauge located on the outside of the tank for indicating to the operator the temperature of the contents inside of the tank.

Once the hydrocarbon residue is transported to the second vessel, the method of the present invention further comprises the step of heating a sufficient amount of an organic solvent in the second vessel or Baker tank. The organic solvent is used to dilute the hydrocarbon residue and convert the hydrocarbon residue from a waxy solid material to a liquid material. The organic solvent may comprise gas oil, diesel oil, stove oil (fuel jet), toluene, cyclohexane, naphtha, and xylenes. However, other suitable organic solvents or refinery intermediates may also be used. The preferred organic solvents used are gas oil, diesel oil, and stove oil. It is preferable to use an organic solvent that is light in weight, readily available, inexpensive, has a high flash point, has low evaporation, is a good oil refinery process intermediate, and that can be easily recycled into a usable refinery product. For purposes of this application, "flash point" means the lowest temperature at which the application of a small flame causes the vapor above a flammable liquid to ignite when the liquid is heated in a standard cup under prescribed conditions. The preferred amount or ratio of solvent to hydrocarbon residue used in the present invention is in a ratio in the range of from about 3:1 to about 10:1, solvent to hydrocarbon residue. When gas oil is mixed with the hydrocarbon residue in the second vessel or Baker tank, the preferred amount of gas oil used is in the ratio of 7 parts gas oil to 1 part hydrocarbon residue, based on the total amount of the mixture. When diesel oil is mixed with the hydrocarbon residue in the second vessel or mixing tank, the preferred amount of diesel oil used is in the ratio of 5 parts diesel oil to 1 part hydrocarbon residue. When stove oil is mixed with the hydrocarbon residue in the second vessel or mixing tank, the preferred amount of stove oil used is in the ratio of 3 parts stove oil to 1 part hydrocarbon residue.

The organic solvent is heated alone in the second vessel at a temperature in the range of from about 130 degrees F. to about 200 degrees F. for an effective period of time. Preferably, the solvent is heated at a temperature in the range of from about 150 degrees F. to about 180 degrees F. The organic solvent is heated alone in the second vessel or Baker tank for a period of time of from about 5 minutes to about 4 hours. Preferably, the organic solvent is heated in the second vessel or Baker tank for 2 hours.

Once the organic solvent is heated for an effective period of time so that it reaches the preferred heating temperature, the hydrocarbon residue is added to the heated solvent in the second vessel or Baker tank. First, the hydrocarbon residue is removed from the first vessel or vessels. If a 220 gallon polypropylene lined cardboard box is used, such removal may be accomplished by lifting each box via a forklift to the top of the Baker tank, positioning the box over the top opening of the Baker tank, and manually cutting the bottom of the box with a sharp object such as a knife in order to empty the contents of the box into the Baker tank. If a steel cylinder 55 gallon drum is used, such removal may be accomplished by lifting each drum via a forklift to the top of the Baker tank, positioning the drum over the top opening of the Baker tank, manually hitting the sides of the drum with a device such as a pole or stick in order to loosen the waxy hydrocarbon residue from the sides of the drum, and when the waxy hydrocarbon residue is sufficiently loosened and separated from the sides and bottom of the drum, turning the drum upside down in order to empty the contents of the drum into the Baker tank. If the hydrocarbon residue cannot be easily removed by beating the drums, the hydrocarbon residue can be initially heated by injecting a steam lance into the hydrocarbon residue in the drum to facilitate removal of the hydrocarbon residue from the drum.

Next, a desired amount of hydrocarbon residue is added into the mixing tank, depending on the size of the tank and the type of solvent used. Typically, about 10–20, 220 gallon boxes may be added continuously to the Baker tank over a desired period of time. Typically, about 40–70, 55-gallon drums of hydrocarbon residue may be added continuously to the Baker tank over a desired period of time. The hydrocarbon residue and the solvent are simultaneously mixed together and heated in the sealed mixing tank at a temperature in the range of from about 130 degrees F. to about 200 degrees F. for an effective period of time to cause a reaction between the hydrocarbon residue and the solvent to produce a liquefied hydrocarbon residue product. Preferably, the hydrocarbon residue and the solvent are simultaneously mixed together and heated in the sealed mixing tank at a temperature in the range of from about 150 degrees F. to about 180 degrees F. The solvent and hydrocarbon residue may be mixed and heated together in the mixing tank for a period of time of from about 1 hour to about 4 hours. Preferably, the solvent and hydrocarbon residue are mixed and heated together in the mixing tank for about 2 hours.

Once the liquefied hydrocarbon residue product is produced, the liquefied hydrocarbon residue is continuously pumped out of the mixing tank via a pump mechanism through a connecting element such as a rubber hose or steel pipe that connects the second vessel or Baker tank to a third vessel. The third vessel may comprise a containment storage in-ground reservoir having a concrete lining, a steel storage tank, a concrete storage tank, a storage tank where part of the tank is above ground and part of the tank is below ground, or another suitable storage vessel. Preferably, the third vessel is an in-ground reservoir having a concrete lining. The reservoir may have a roof or covering over it comprised of wood or another suitable material. The capacity of the reservoir having a concrete lining may be from about 20,000 barrels to about 2 million barrels. The third vessel is separate from the second vessel. Preferably, the third vessel is located close to the second vessel so the processed hydrocarbon residue does not have to be pumped as far and thus the amount of power and energy utilized is less. Preferably, the third vessel is located at least 5 feet away from the second vessel but less than 500 feet from the second vessel. The liquefied hydrocarbon residue may be pumped out of the Baker tank at a rate of from about 200 barrels per hour to about 600 barrels per hour. Preferably, the liquefied hydrocarbon residue is pumped out of the Baker tank at rate of about 400 barrels per hour.

Once the liquefied hydrocarbon residue is pumped into the third vessel, it can be stored for recycling for an indefinite period of time or it can be recycled fairly quickly such as within 2 hours. The liquefied hydrocarbon residue is preferably recycled or converted into a usable oil refinery product. With the present invention, the total time for processing the hydrocarbon residue into a usable oil refinery product is typically from about 4 hours to about 5 days.

With the present invention, after the desired amount of liquefied hydrocarbon residue has been processed, a small amount of unprocessed material, such as sediment, may remain in the bottom of the second vessel or Baker tank. This unprocessed material may be collected when the second vessel is cleaned and may be transferred into storage vessels such as cylinder drums or roll-off bins. This unprocessed material may be disposed of as a waste stream.

EXAMPLE I

This Example describes a determination of the contents of a hydrocarbon residue sample and a determination of the suitable solvents used in the method of the present invention.

To determine the water content of the hydrocarbon residue sample, approximately 2 grams of the hydrocarbon residue sample were weighed into a tared 30-ml porcelain evaporating dish. The sample was heated for 2 hours in a drying oven held at 220 degrees F. It was then cooled in a desiccator to room temperature for about one hour. It was weighed again, and the percent weight loss, the water content, was calculated.

To determine the amount of inorganic solids in the hydrocarbon residue sample, the material remaining from the water content measurement was heated overnight in a muffle furnace held at 1200 degrees F. The sample was then cooled in a desiccator to room temperature for about one hour. It was weighed again, and the percent of remaining material, the inorganic solids or ash content, was calculated.

The percent difference between the dried weight and the ashed weight was calculated. This was the hydrocarbon, or organic, content.

The hydrocarbon residue sample was characterized for applicability for a specific application using a standard method referred to as ASTM D2007. This standard method classifies a hydrocarbon according to its content of polar compounds, aromatics, saturates, and insolubles according to a specific procedure. The definitions of these classifications are limited to this specific procedure.

Solvents were tested for suitability for use in the present invention by the following method. About 5 grams of the hydrocarbon sample were weighed into a glass beaker and heated to between 130 degrees F. and 220 degrees F. in a drying oven until it became a liquid. A measured amount of a proposed solvent was added and the mixture stirred. The mixture was then filtered through a tared paper filter with pore size about 2.5 microns (Whatman 42 or equivalent). Heat was applied to the liquid during filtration to keep the mixture liquid, using a hand held hair dryer. The solids on the filter were washed 3 times with small amounts of the solvent, then 3 times with pentane. The filter was dried at 95 degrees F., then cooled and weighed. The percent of insoluble material was calculated. If the insoluble material by this measurement was the same as the inorganic solids content, the solvent was considered suitable for further consideration.

The proposed end use determined the optimum physical and compositional properties of the mixture. To evaluate the best ratio of solvent to hydrocarbon residue for the proposed use of the mixture, these properties were measured on a range of mixtures. Solvent-to-hydrocarbon residue ratios were made by the following method. Known amounts of the hydrocarbon residue were weighed into glass jars and heated to between 150 degrees F. and 220 degrees F. in a drying oven until it became a liquid. A measured amount of the solvent required to achieve the proposed ratio was added and the mixture stirred.

A typical hydrocarbon residue contained the following components: 16% water, 81% hydrocarbons, and 3% inorganic solids. The typical 81% hydrocarbon portion was characterized as: 36% pentane insolubles, 32% saturates, 22% aromatics, and 10% polar compounds. Solvent-to-hydrocarbon residue ratios were made using refinery streams of naphtha, stove oil, diesel oil, light gas oil, heavy gas oil, reformate, toluene, and light cycle oil. Other refinery process streams, hydrocarbon products or solvents could also be used, depending on cost considerations and the desired properties of the mixture.

EXAMPLE II

This Example describes how a version of the method of the present invention was conducted. Approximately 350 barrels of gas oil were pumped from a gas oil reservoir into a Baker tank using a piping connection off of the reservoir circulating line. The valve for a 150 pound steam system to a heating coil connected to the Baker tank was opened. The gas oil in the Baker tank was heated to approximately 180 degrees F. which took about 2 hours. The temperature in the Baker tank was monitored using a temperature gauge mounted on the outside of the Baker tank. After the gas oil was heated to 180 degrees F., the mixers in the Baker tank were turned on, and 50 barrels containing waxy hydrocarbon residue were continuously poured into the hatch opening at the top of the Baker tank for about 3–4 hours. The 50 barrels were contained in waste bins comprising cardboard boxes completely lined with polypropylene material, and a forklift was used to pick up each waste bin and lift the waste bin to the top of the Baker tank. The bottom of the waste bin was cut open to allow the contents of the waste bin to drop through the hatch opening at the top of the Baker tank. The gas oil and the waxy hydrocarbon residue were continuously mixed together for about 4 hours in the Baker tank and maintained at a temperature of 180 degrees F. Once the gas oil and hydrocarbon residue were sufficiently heated and mixed, a portable diesel-driven pump was lined up from the Baker tank to the gas oil reservoir, that is, the valves from the Baker tank to the pump were opened, and the contents of the Baker tank were pumped out of the Baker tank to the gas oil reservoir. The gas oil reservoir recirculating system was lined up and the recirculating pump was started, that is, the valves on the recirculating line were opened and the pump was started to recirculate the contents of the Baker tank to the gas oil reservoir. The liquid contents of the Baker tank, or approximately 400 barrels in the Baker tank, were pumped into the gas oil reservoir via the recirculating line for approximately 90 minutes. About 5 drums of dirt and scale that had settled in the Baker tank during the process were cleaned out of the Baker tank after the process had been carried out.

Although the present invention has been described in considerable detail with reference to certain preferred versions thereof, other versions are possible. Therefore, the scope of the appended claims should not be limited to the description of the preferred versions contained herein.

What is claimed is:

1. A method for recovering and recycling hydrocarbon residue from a petroleum material, the method consisting essentially of:

providing the hydrocarbon residue in a first vessel, wherein the hydrocarbon residue is in the form of solid waxy material;

heating a sufficient amount of an organic solvent in a second vessel for an effective period of time to reach a temperature in the range of from 130 degrees F. to about 200 degrees F.;

removing the hydrocarbon residue from the first vessel and adding the hydrocarbon residue to the heated solvent in the second vessel;

simultaneously mixing and heating the hydrocarbon residue and the solvent in the second vessel at a temperature in the range of from about 130 degrees F. to about 200 degrees F. for an effective period of time to cause a reaction between the hydrocarbon residue and the solvent to produce a liquefied hydrocarbon residue product;

pumping the liquefied hydrocarbon residue product out of the second vessel and into a third vessel; and, recycling the liquefied hydrocarbon residue into a usable oil refinery product.

2. The method of claim 1 wherein the petroleum material is crude oil.

3. The method of claim 1 wherein the organic solvent is selected from the group consisting of gas oil, diesel oil, stove oil, toluene, cyclohexane, naphtha, and xylenes.

4. The method of claim 1 wherein the organic solvent is gas oil, such that when the gas oil is mixed with the hydrocarbon residue, the ratio of the amount of gas oil to hydrocarbon residue is 7 parts to 1 part.

5. The method of claim 1 wherein the organic solvent is stove oil, such that when the stove oil is mixed with the hydrocarbon residue, the ratio of the amount of stove oil to hydrocarbon residue is 3 parts to 1 part.

6. The method of claim 1 wherein the organic solvent is diesel oil, such that when the diesel oil is mixed with the hydrocarbon residue, the ratio of the amount of diesel oil to hydrocarbon residue is 5 parts to 1 part.

7. The method of claim 1 wherein when the organic solvent and hydrocarbon residue are mixed and heated, the ratio of the amount of organic solvent to hydrocarbon residue is in the range of from about 3:1 to 10:1.

8. The method of claim 1 wherein the hydrocarbon residue comprises by weight of the total composition, from about 0% to about 25% water by weight; from about 70% to about 100% hydrocarbons by weight; and from about 0% to about 5% inorganic solids by weight.

9. The method of claim 1 wherein the solvent is heated alone in the second vessel for a period of time of from about 5 minutes to about 4 hours.

10. The method of claim 1 wherein the solvent and the hydrocarbon residue are heated together in the second vessel at a temperature in the range of from about 150 degrees F. to about 180 degrees F.

11. The method of claim 1 wherein the solvent and hydrocarbon residue are mixed and heated together for a period of time of from about 1 hour to about 4 hours.

12. The method of claim 1 wherein providing the hydrocarbon residue further comprises collecting and recovering the hydrocarbon residue from an oil tanker ship during a cleaning operation of the ship.

13. The method of claim 1 wherein the first vessel comprises a cardboard box lined with a polypropylene lining, and wherein the cardboard box has a capacity of about 220 gallons.

14. The method of claim 1 wherein the first vessel comprises a 55 gallon steel cylinder drum container.

15. The method of claim 1 wherein the second vessel is a steel mixing tank capable of being sealed and having a capacity of from about 50 barrels to about 500 barrels and wherein the tank has a heating element for heating the solvent and the hydrocarbon residue, at least one mixing element for mixing the solvent and the hydrocarbon residue, at least one connecting element for connecting the second vessel to the third vessel, a pump element for pumping the liquefied hydrocarbon residue out of the second vessel and into the third vessel, and a carbon cannister for vapor control.

16. The method of claim 1 wherein the third vessel is a storage containment reservoir having a concrete lining, and wherein the reservoir has a capacity of from about 20,000 barrels to about 2 million barrels.

17. The method of claim 1 wherein the liquefied hydrocarbon residue is pumped out of the second vessel at a rate of about 400 barrels per hour.

18. A method for recovering and recycling waxy hydrocarbon residue from crude oil, the method consisting essentially of:

collecting and storing the waxy hydrocarbon residue in a plurality of cardboard boxes lined with polypropylene lining, wherein the waxy hydrocarbon residue is in the form of a solid material;

heating a sufficient amount of gas oil in a sealed steel tank at a temperature in the range of from about 150 degrees F. to about 180 degrees F. for a time period of from about 5 minutes to about 4 hours, wherein the tank has a heating element and a mixing element, and has a capacity of from about 50 barrels to about 500 barrels, adding the waxy hydrocarbon residue to the heated gas oil in the tank, wherein the ratio of the amount of waxy hydrocarbon residue to gas oil is 1 part waxy hydrocarbon residue to 7 parts gas oil;

simultaneously mixing and heating the waxy hydrocarbon residue and the gas oil in the tank at a temperature in the range of from about 150 degrees F. to about 180 degrees F. for a time period of from about 1 hour to about 4 hours to cause a reaction between the waxy hydrocarbon residue and the gas oil to produce a liquefied waxy hydrocarbon residue product;

pumping the liquefied waxy hydrocarbon residue out of the tank at a rate of about 400 barrels per hour and into a storage containment reservoir having a concrete lining, wherein the reservoir is located at a site separate from and at a distance from the mixing tank; and, recycling the liquefied waxy hydrocarbon residue into a usable oil refinery product.

* * * * *